US005893824A

United States Patent [19]

Schlough

[11] Patent Number: 5,893,824

[45] Date of Patent: Apr. 13, 1999

[54] TRANSFER DRUM ASSEMBLY FOR SIGNATURE HANDLING

[75] Inventor: James Richard Schlough, Troy, Ohio

[73] Assignee: Heidelberg Finishing Systems, Inc., Dayton, Ohio

[21] Appl. No.: 08/696,347

[22] Filed: Aug. 13, 1996

[51] Int. Cl.[6] ..... B65H 5/20; B65H 47/00

[52] U.S. Cl. ..... 493/409; 270/52.27

[58] Field of Search ..... 493/409, 465, 493/471; 270/52.26, 52.27, 52.28, 52.29

[56] References Cited

U.S. PATENT DOCUMENTS

| | | | |
|---|---|---|---|
| 2,163,732 | 6/1939 | Kleinberg | 270/52.27 |
| 2,413,358 | 12/1946 | Kleinberg | 270/52.27 |
| 3,809,384 | 5/1974 | Zugel . | |
| 4,706,950 | 11/1987 | Ruetschle et al. . | |
| 4,875,669 | 10/1989 | McCain | 270/52.27 |
| 5,447,302 | 9/1995 | Curley . | |

*Primary Examiner*—Jack W. Lavinder
*Attorney, Agent, or Firm*—Tarolli, Sundheim, Covell, Tummino & Szabo

[57] ABSTRACT

A signature handling apparatus includes a rotatable gripper drum having at least one gripper for gripping the folded leading edges of signatures. A rotatable transfer drum assembly transfers signatures from the gripper drum to an opener drum. The transfer drum assembly includes a transfer gripper. First drive means rotates the gripper drum to move the folded signatures at a first surface speed in a first direction adjacent to the transfer drum. Second drive means moves the transfer gripper at a second surface speed in the first direction into engagement with the trailing edge of one respective signature on the gripper drum. The second surface speed is greater than the first surface speed. The second drive means rotates the transfer drum to move the transfer gripper and the one signature toward the opener drum. The opener drum has means for assisting in opening the one signature.

11 Claims, 8 Drawing Sheets

TRANSFER DRUM ASSEMBLY FOR SIGNATURE HANDLING

BACKGROUND OF THE INVENTION

1. Technical Field

The present invention relates to a folded signature handling apparatus.

2. Description of the Prior Art

A known apparatus for handling folded signatures includes a rotatable gripper drum which grips each signature by its folded edge. The gripper drum carries each signature to a position where it is released into a register stop. A transfer drum then grips the trailing edge of the signature and transfers the signature to an opener drum. The opener drum and the transfer drum cooperate to open the folded signature. If a signature is not moved completely into the register stop, or if a signature is moved too far into the register stop, the trailing edge of the signature is in an incorrect position for being picked up by the transfer drum.

SUMMARY OF THE INVENTION

The present invention is an apparatus comprising a rotatable gripper drum having at least one gripper for gripping and releasing signatures. Each signature has a folded leading edge and a trailing edge. The gripper grips the folded leading edge of signatures. The apparatus also comprises a rotatable opener drum and a rotatable transfer drum assembly for transferring signatures from the gripper drum to the opener drum. The transfer drum assembly has at least one transfer gripper. First drive means rotates the gripper drum to move the folded signatures at a first surface speed in a first direction adjacent to the transfer drum assembly. Second drive means moves the transfer gripper at a second surface speed in the first direction into engagement with the trailing edge of one respective signature on the gripper drum. The second surface speed is greater than the first surface speed. The second drive means rotates the transfer drum assembly to move the transfer gripper and the one signature toward the opener drum. The opener drum has means for assisting in opening the one signature.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
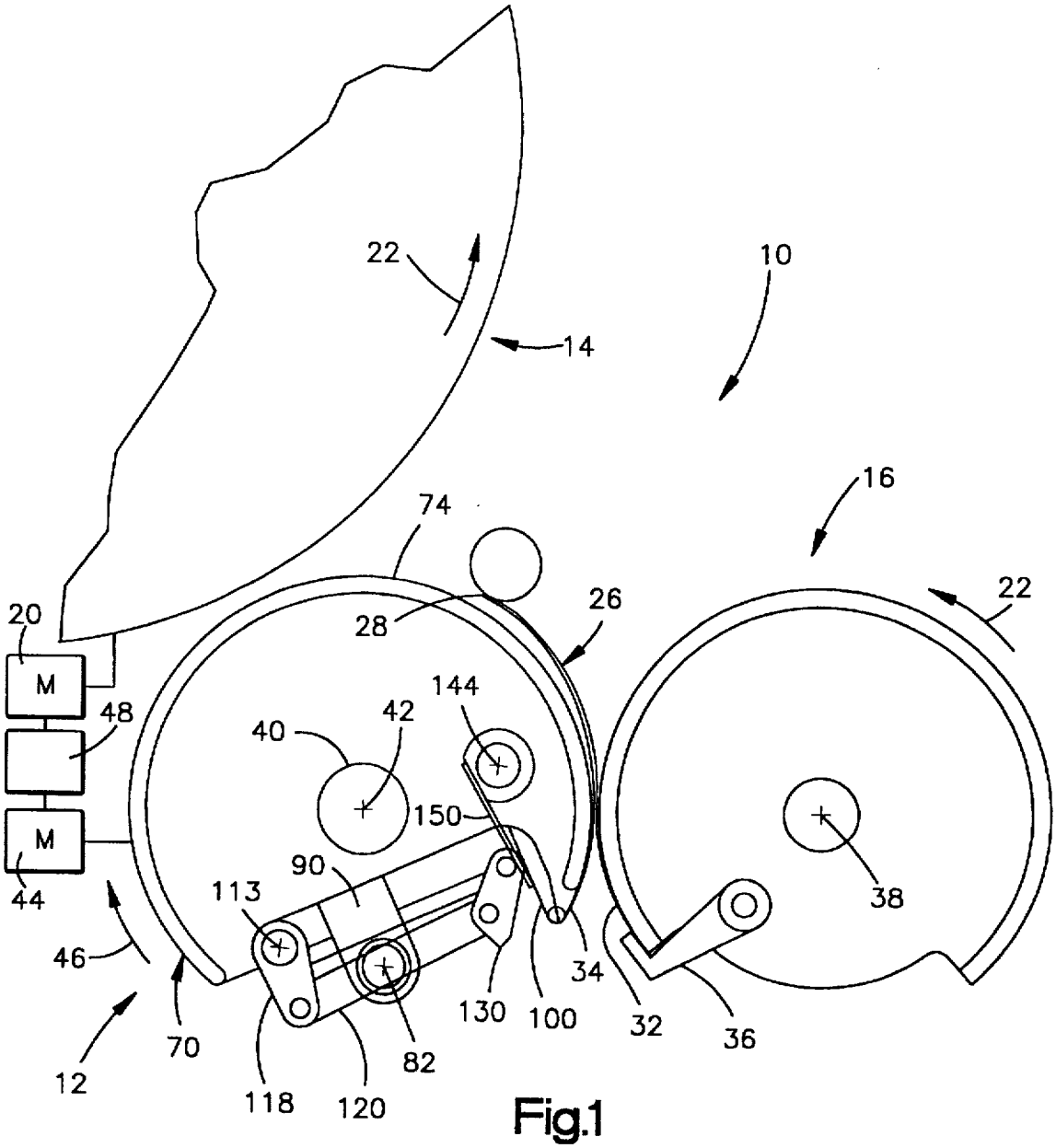
FIG. 1 is a schematic view of a signature handling apparatus constructed in accordance with the present invention including a gripper drum, a transfer drum assembly, and an opener drum.

The present invention relates to an apparatus for handling folded signatures. As representative of the present invention, FIG. 1 illustrates a signature handling apparatus 10. The signature handling apparatus 10 includes a gripper drum 14, an opener drum 16, and a transfer drum assembly 12 for transferring signatures from the gripper drum to the opener drum. The opener drum 16 and transfer drum assembly 12 cooperate to open a signature and release the signature for deposit on a saddle of a collator as is known.

The gripper drum 14 is supported for rotation about an axis (not shown). Drive means such as a motor indicated schematically at 20 drives the gripper drum 14 for rotation about the axis in a direction indicated by the arrow 22, that is, counter-clockwise as viewed in FIG. 1.

Figure 5:
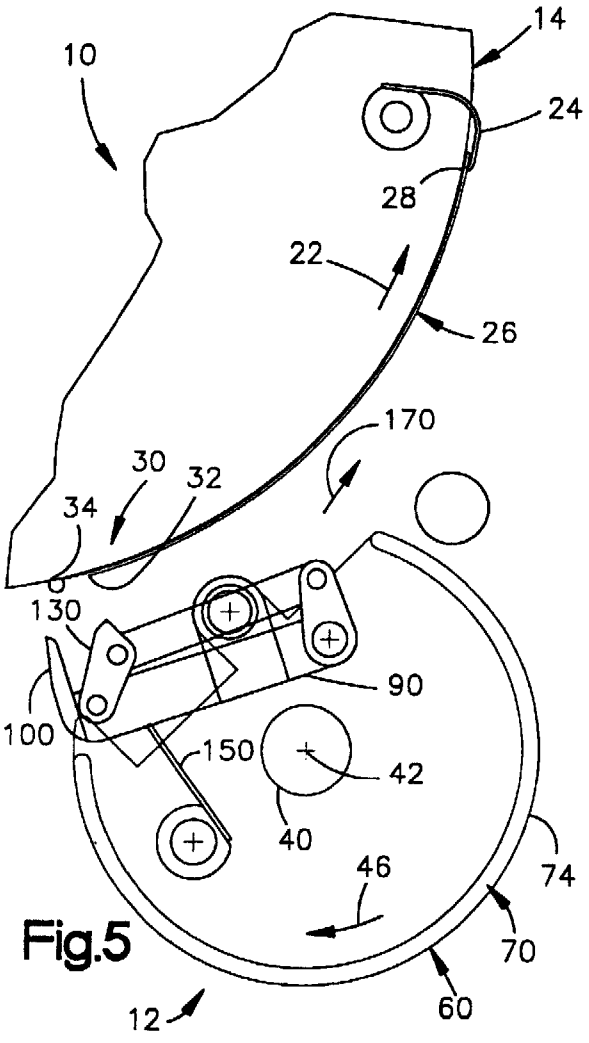

Preferably, three grippers are spaced apart at uniform intervals around the circumference of the gripper drum. However, a different number of grippers may be on the gripper drum 14. One of the grippers is shown schematically at 24 (FIGS. 5–9). Each one of the grippers, such as the gripper 24, is operable in a known manner to grip and, thereafter, releases a signature such as the signature 26. Each one of the signatures including the signature 26 is gripped at it s folded edge 28 (FIG. 5). Each signature 26 has a lap edge 30 opposite the folded edge 28. Each signature 26 includes a short lap 32 and a long lap 34.

The opener drum 16 (FIG. 1) includes a gripper 36 and assists in opening signatures transferred by the transfer drum assembly 12. The opener drum 16 is supported for rotation about an axis 38 in the same direction of rotation 22 as the gripper drum 14.

Figure 2:
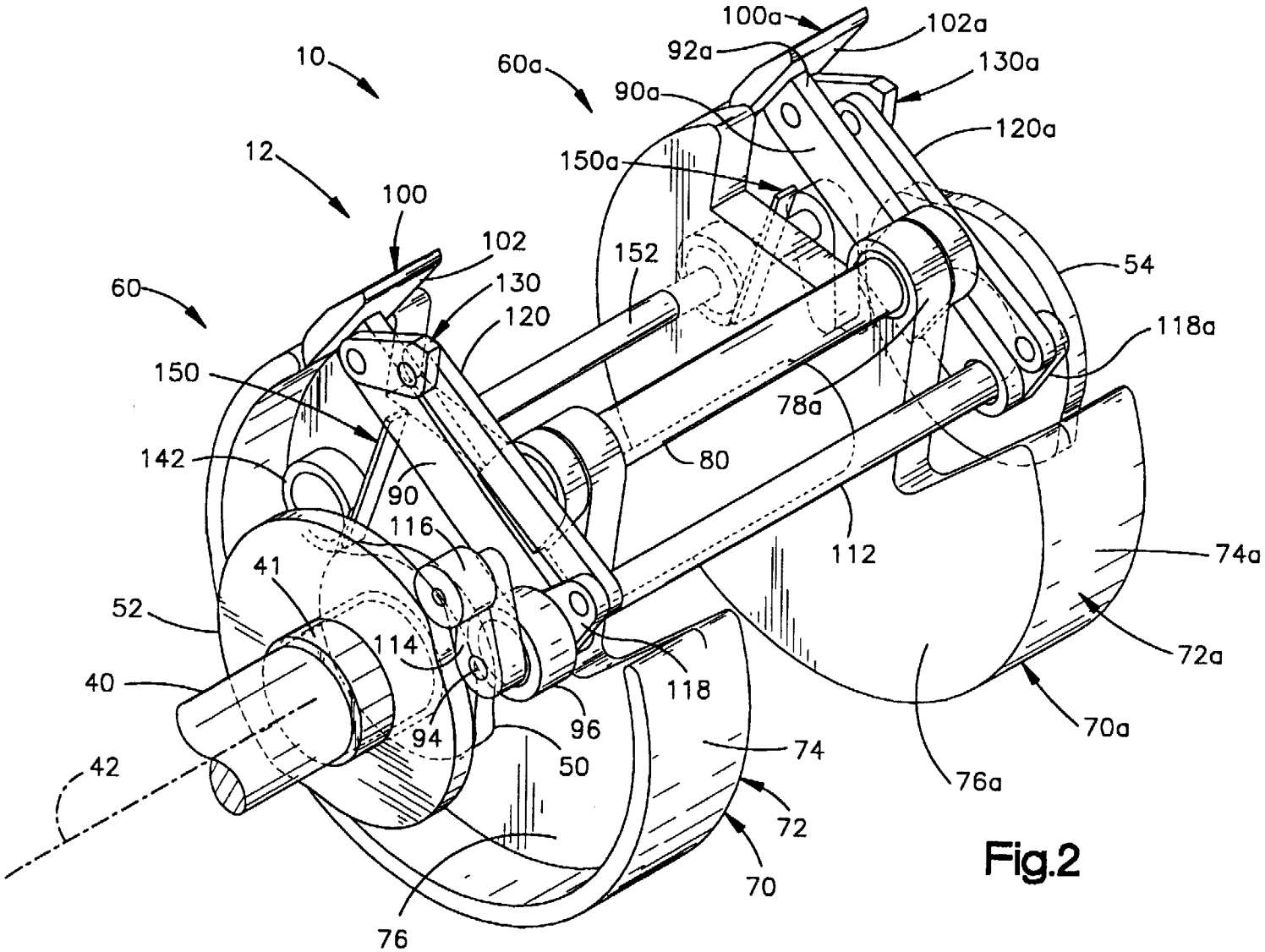
FIG. 2 is a perspective view of the transfer drum assembly of FIG. 1.
Figure 3:
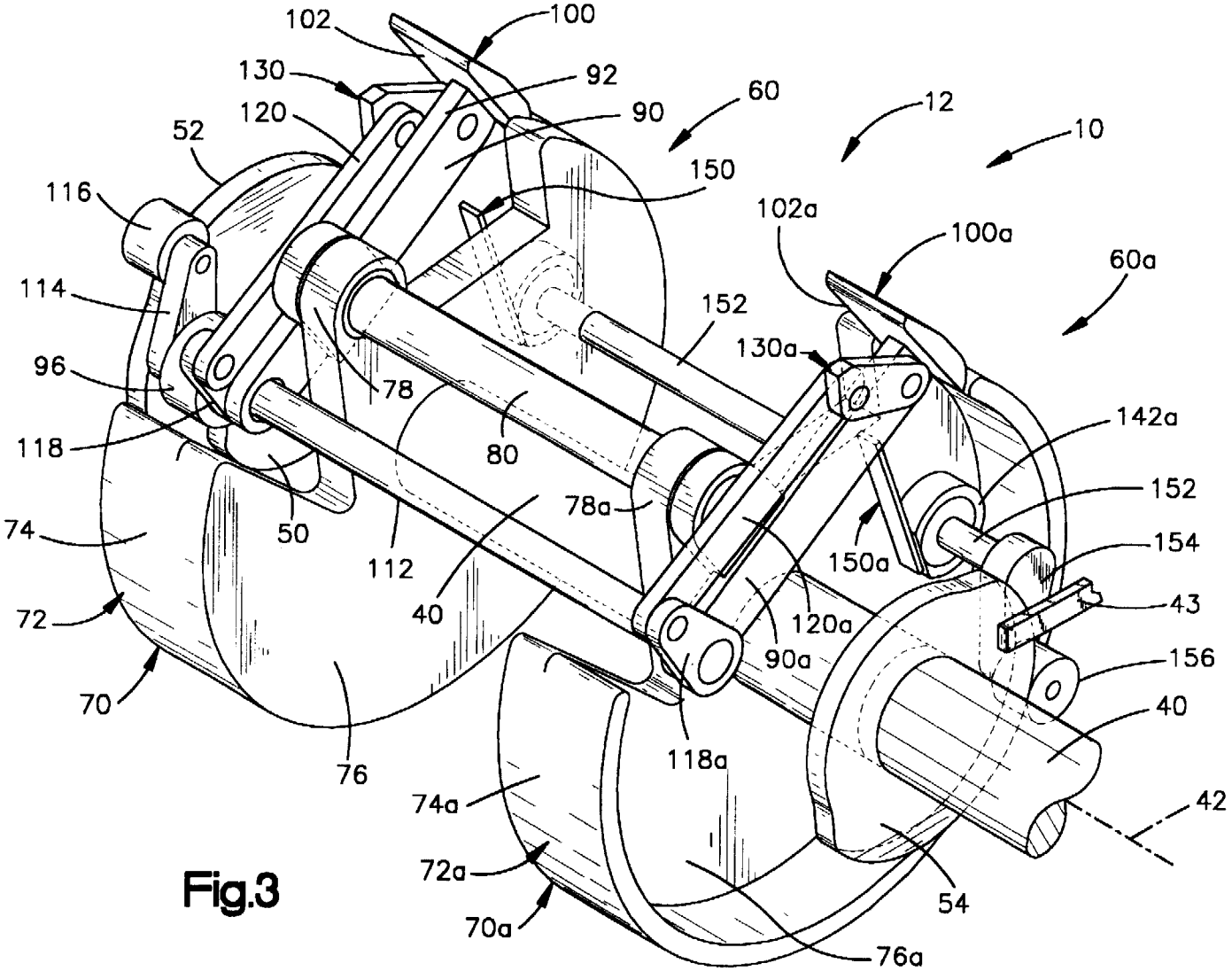
FIG. 3 is another perspective view of the transfer drum assembly of FIG. 1.

A main drive shaft 40 (FIGS. 1–4) is supported for rotation, in a stationary sleeve or bearing 41 (FIG. 2), about a main axis 42. The main axis 42 extends parallel to the axis of rotation of the gripper drum 14 and parallel to the axis of rotation 38 of the opener drum 16. Drive means such as a motor indicated schematically at 44 (FIG. 1) drives the main drive shaft 40 for rotation about the axis 42 in a direction indicated by the arrow 46, that is, clockwise as viewed in FIG. 1. Timing means indicated schematically at 48 synchronizes the rotation of the gripper drum 14, the transfer drum assembly 12, and the opener drum 16. Alternatively, the gripper drum 14, the transfer drum assembly 12 and the opener drum 16 could be driven through suitable drive mechanisms from a common motor.

The transfer drum assembly 12 (FIGS. 2 and 3) includes a gripper seat cam 50, a short lap gripper cam 52, and a long lap gripper cam 54. The cams 50–54 are positioned in a coaxial relationship with the main drive shaft 40. The cams 50 and 52 (FIG. 2) are fixed to the stationary sleeve 41. A torque arm 43 (FIG. 3) extends between the cam 54 and a frame (not shown) of the apparatus 10 and blocks rotation of the cam 54. The main drive shaft 40 rotates relative to the cams 50–54.

The transfer drum assembly 12 includes first and second transfer units 60 and **60*a* which are substantially mirror images of each other. The transfer units 60 and 60*a* engage axially spaced portions of signatures such as the signature 26 on the gripper drum 14. Parts of the second transfer unit 60*a* which are similar or identical to parts of the first transfer unit 60 are given the same reference numeral but with the suffix "a" added for clarity. Parts of one transfer unit 60 or 60*a*** which are not described are identical to the corresponding parts of the other transfer unit.

The transfer unit 60 includes a transfer drum 70. The transfer drum 70 is fixed for rotation with the drive shaft 40 about the main axis 42. The transfer drum 70 has an axially extending, cylindrical side wall 72 centered on the axis 42. The side wall 72 has a cylindrical, outer peripheral surface 74. The transfer drum 70 also has a radially extending end wall 76. A portion of the end wall 76 of the transfer drum 70 forms a bearing block 78.

Figure 4:
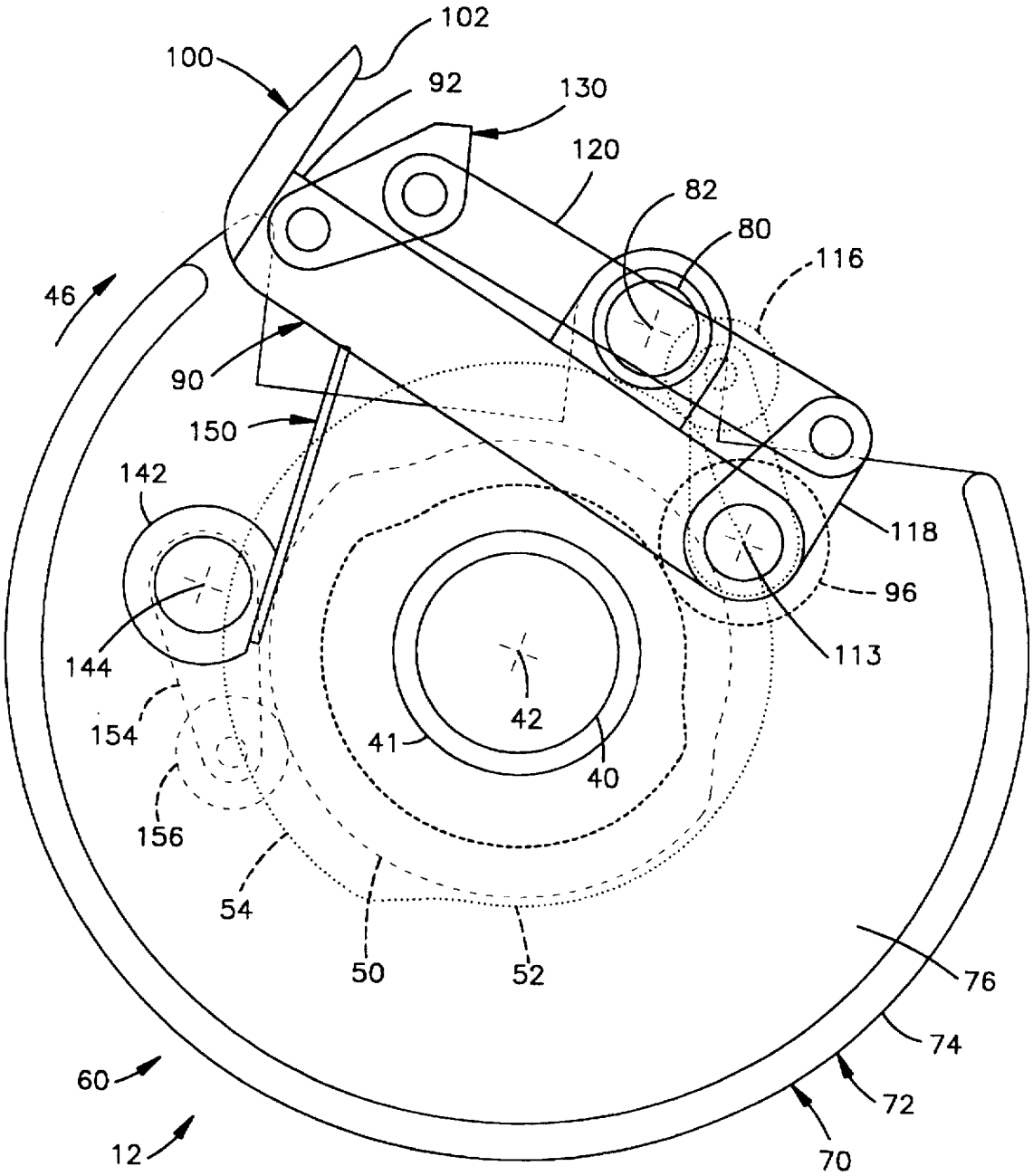
FIG. 4 is an enlarged schematic view of portions of the transfer drum assembly of FIG. 1.
Figure 7:
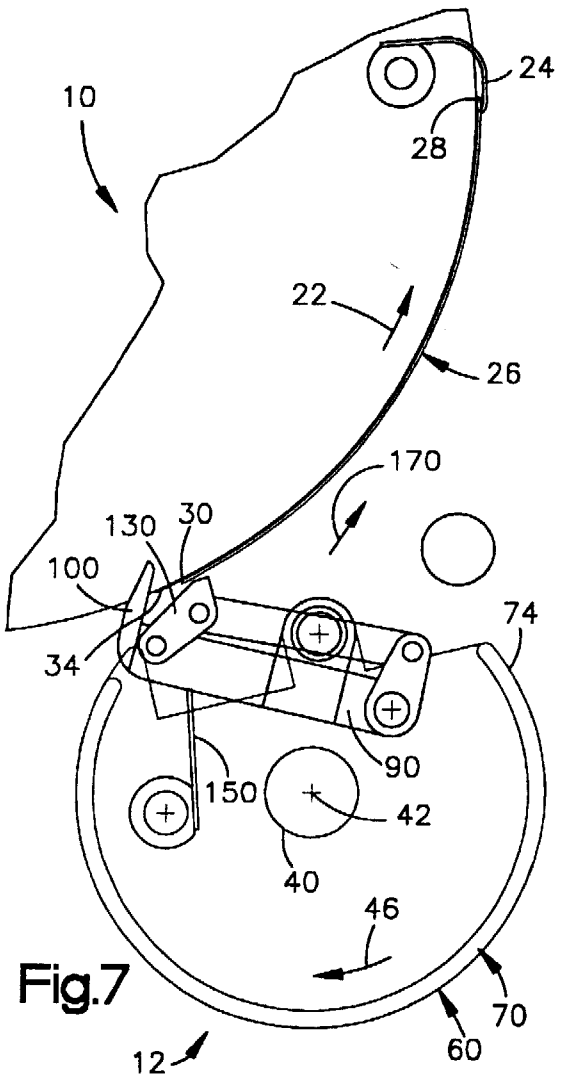
FIGS. 5–15 are views similar to FIG. 1 showing parts of the signature handling apparatus in sequential positions of operation.
Figure 6:
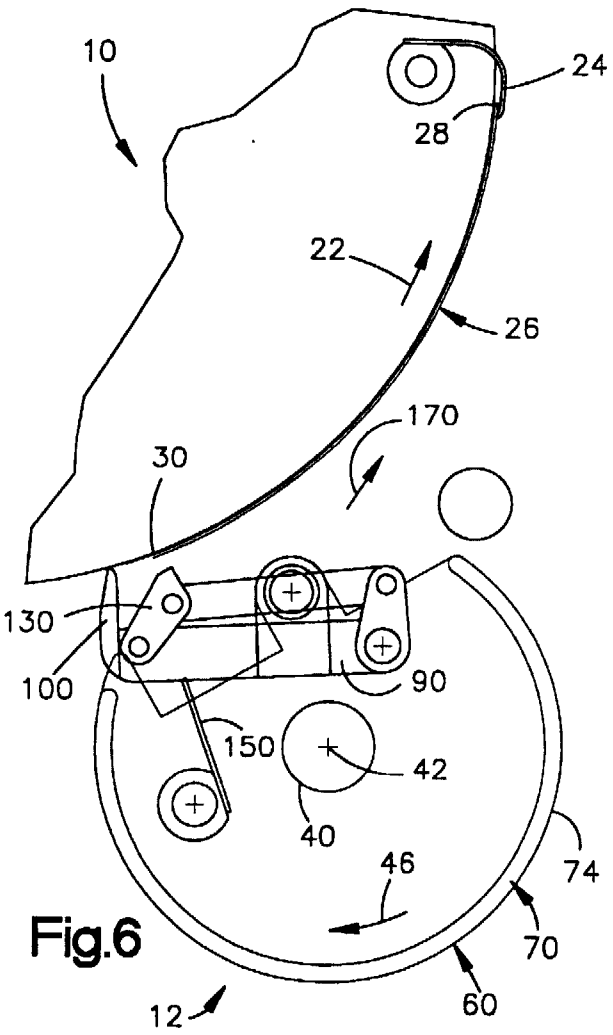

The bearing block 78 supports a rocker shaft 80 for rotation about a gripper seat pivot axis 82 (FIG. 4). A pair of rocker arms 90 and 90*a* are fixed for movement with the rocker shaft 80. The rocker arms 90 and 90*a* are thereby supported for pivotal movement about the gripper seat pivot axis 82.

A gripper seat follower shaft 94 is fixed to a first end portion of the rocker arm 90. A gripper seat cam follower 96 is rotatably supported on the gripper seat follower shaft 94. The gripper seat cam follower 96 is engageable with the gripper seat cam 50, in a manner described below, to control the pivotal movement of the rocker arms 90 and 90*a*.

A gripper seat 100 is fixed to a second end portion of the rocker arm 90. The gripper seat 100 has a gripping surface 102. The rocker arm 90 has an engagement surface 92, adjacent to the gripper seat 100. On the second transfer unit 60*a*, a gripper seat 100*a* is fixed to the rocker arm 90*a*. The gripper seat 100*a* has a gripping surface 102*a* and the rocker arm 90*a* has an adjacent engagement surface 92*a*.

A short lap gripper actuator shaft 112 extends between the first and second transfer units 60 and 60*a*. The actuator shaft 112 is supported for rotation, within the rocker arms 90 and 90*a*, about an axis 113 (FIG. 4). A follower arm 114 (FIG. 2) is fixed to one end of the actuator shaft 112. A short lap gripper cam follower 116 is supported for rotation on the follower arm 114.

A pair of actuator links 118 and 118*a* are fixed to opposite ends of the actuator shaft 112. The actuator links 118 and 118*a* are pivotally connected with a pair of drive links 120 and 120*a*, respectively. The drive links 120 and 120*a* extend generally parallel to, but are spaced apart from, the rocker arms 90 and 90*a*, respectively.

A transfer gripper or short lap gripper 130 is connected for pivotal movement between the drive link 120 and the rocker arm 90. On the second transfer unit 60*a* a transfer gripper or short lap gripper 130*a* is connected for pivotal movement between the drive link 120*a* and the rocker arm 90*a*. The short lap gripper cam follower 116 is engageable with the short lap gripper cam 52, in a manner described below, to control the pivotal movement of the short lap grippers 130 and 130*a*.

A collar 142*a* (FIG. 3) is supported on the transfer drum 70*a* for pivotal movement relative to the transfer drum about a pivot axis 144 (FIG. 4). A long lap gripper 150*a* (FIGS. 2–4) is fixed for movement with the collar 142*a*. A pivot shaft 152 is also fixed for movement with the collar 142*a*. The pivot shaft. 152 is rotatable about the axis 144. A follower arm 154 is fixed to the pivot shaft 152. A long lap gripper cam follower 156 is supported for rotation on the follower arm 154.

The pivot shaft 152 extends between the second transfer unit 60*a* and the first transfer unit 60. On the first transfer unit 60*a*, a long lap gripper 150 is fixed for movement with the pivot shaft 152. The long lap gripper cam follower 76 is engageable with the long lap gripper cam 54, in a manner described below, to control the pivoting movement of the long lap grippers 150 and 150*a*.

When the signature handling apparatus 10 is in operation, a plurality of signatures, such as the signature 26, are handled sequentially by the apparatus 10. The handling of the one signature 26 will be described as exemplary.

The gripper 24 on the gripper drum 14 grips the folded, leading edge 28 of the signature 26. The gripper drum 14 is continuously rotated at a first surface speed in the direction 22. The transfer drum assembly 12 is continuously rotated in the opposite direction 46. The transfer drum assembly 12 rotates once during the time period in which successive signatures 26 move into the position shown in FIG. 5. Thus, the transfer drum assembly 12 rotates three times for each rotation of the gripper drum 14.

The transfer drum assembly 12 rotates at a second surface speed which is greater than the first surface speed of the gripper drum 14. For example, the gripper drum 14 may be driven for rotation at a surface speed of about 14 inches per cycle, while the transfer drum assembly 12 is driven for rotation at a surface speed about 50 percent greater, that is, about 21 inches per cycle. The circumferential spacing between adjacent grippers 24 on the gripper drum 14 would thus be about 14 inches, while the circumference of the transfer drum 70 would be about 50 percent greater, that is, about 21 inches.

As the transfer drum assembly 12 rotates about the axis 42, the gripper seat cam follower 96 revolves around the gripper seat cam 50. Radial movement of the gripper seat cam follower 96, resulting from engagement with the non-circular outer periphery of the gripper seat cam 50, causes the rocker arm 90 on the first transfer unit 60 to pivot about the gripper seat pivot axis 82. The pivotal movement of the rocker arm 90 is transmitted by the rocker shaft 80 to the rocker arm 90*a* on the second transfer unit 60*a*. The rocker arm 90*a* moves in synchronism with the rocker arm 90. The gripper seats 100 and 100*a* move in synchronism with each other and with the rocker arms 90 and 90*a*.

During rotation of the transfer drum assembly 12, the short lap gripper cam follower 116 revolves around the short lap gripper cam 52. Radial movement of the short lap gripper cam follower 116, resulting from engagement with the non-circular outer periphery of the short lap gripper cam 52, causes the short lap gripper 130 on the first transfer unit 60 to pivot toward or away from the gripper seat 100. The radial movement of the short lap gripper cam follower 116 is also transmitted by the actuator shaft 112 to the short lap gripper 130*a* on the second transfer unit 60*a*. The short lap gripper 130*a* moves toward and away from the gripper seat 100*a*, in synchronism with the short lap gripper 130.

As the transfer drum assembly 12 rotates, the long lap gripper cam follower 156 revolves around the long lap gripper cam 54. Radial movement of the long lap gripper cam follower 156, resulting from engagement with the non-circular outer periphery of the long lap gripper cam 54, causes the long lap gripper 150*a* on the second transfer unit 60*a* to pivot toward or away from the gripper seat 100*a*. The radial movement of the long lap cam follower 156 is transmitted by the pivot shaft 152 to the long lap gripper 150 on the first transfer unit 60. The long lap gripper 150 moves toward and away from the gripper seat 100, in synchronism with the long lap gripper 150*a*.

Each cycle of rotation of the transfer drum assembly 12 includes a first increment of rotation to the position shown in FIG. 5. During this first increment of rotation of the transfer drum assembly 12, the gripper seat 100 is disposed radially outward of the outer periphery 74 of the transfer drum 70. The short lap gripper 130 is in an open position, that is, spaced apart from the gripper seat 100. The long lap gripper 150 is in an open position, that is, spaced apart from the gripper seat 100. The gripper seat 100 is spaced apart, in a direction to the left as viewed in FIG. 5, from the trailing lap edge 30 of the one signature 26. The signature 26 is moving at the first surface speed in a first direction indicated by the arrow 170, that is, generally to the right as viewed in FIGS. 5–7. The gripper seat 100 is also moving in the first direction 170, at the second surface speed.

Figure 9:
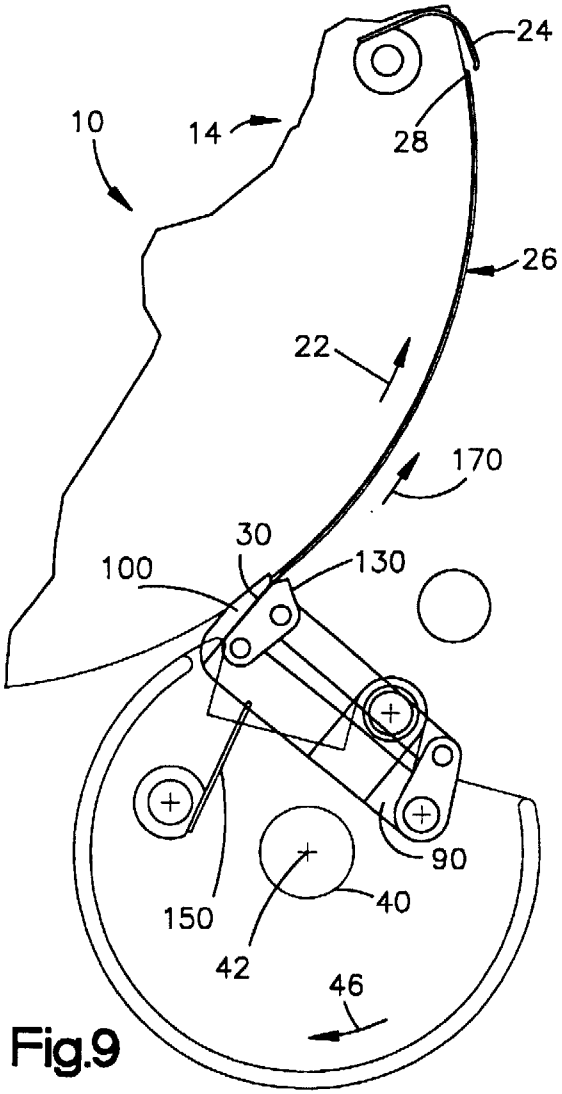
Figure 8:
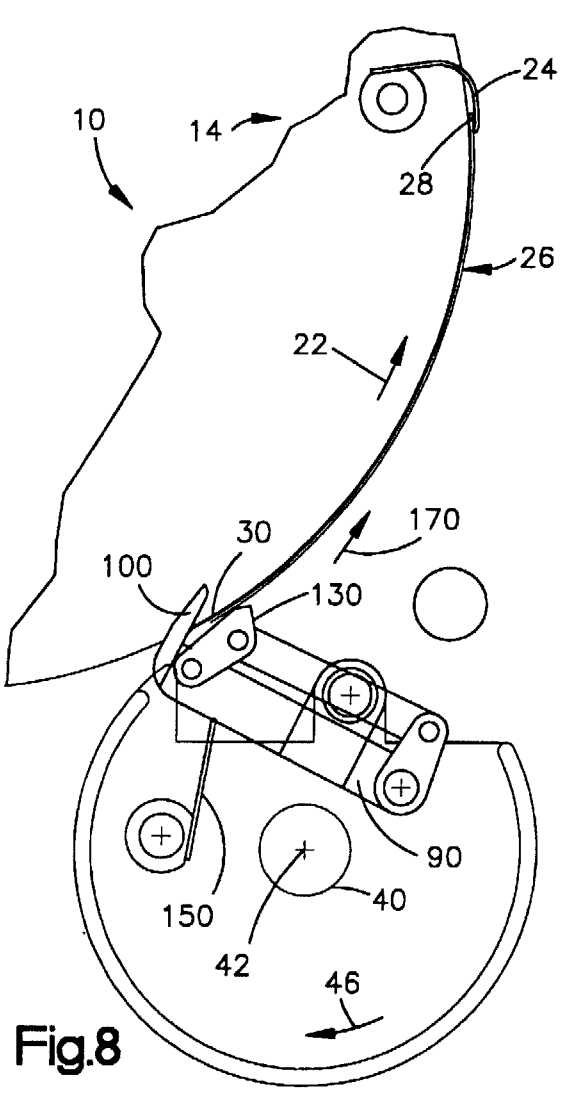

The transfer drum assembly 12 then rotates through a second increment of rotation to the position shown in FIG. 9. The timing means 48 and the greater surface speed of the transfer drum assembly 12 ensure that during the second increment of rotation, the gripper seat 100, moving generally in the first direction 170, overtakes the trailing edge 30 of the signature 26. The long lap 34 of the signature 26 is directed by the gripper surface 102 on the gripper seat 100 into engagement with the engagement surface 92 on the rocker arm 90.

During this second increment of rotation, the short lap gripper 130 begins moving from the open position to the closed position. When the parts of the apparatus 10 reach the position shown in FIG. 9, the short lap gripper 130 is in a closed position holding the signature 26 against the gripper seat 100. Specifically, the short lap gripper 130 holds both the short lap 32 of the signature 26 and the long lap 34 of the signature 26 against the gripper seat 100. As a result, the trailing lap edge 30 of the signature 26 is firmly gripped by the transfer drum assembly 12. At this point in the cycle, the gripper 24 on the gripper drum 14 still grips the folded edge 28 of the signature 26. The long lap gripper 150 is in an open condition, spaced apart from the gripper seat 100.

Because the transfer drum assembly 12 moves at a higher surface speed than the gripper drum 14, the transfer drum assembly "overtakes" the moving lap edge 30 of each signature 26 on the gripper drum. The timing means 168 ensures that the short lap gripper 130 does not close until it is in a position far enough forward to catch the lap edge 30, no matter where positioned, of substantially any signature 26 on the gripper drum 14. The transfer drum assembly 12 is, therefore, able to grip each signature at the same relative point on the signature, regardless of the registration of the signatures relative to the gripper drum 14. This eliminates the need for register stops in the apparatus 10.

For example, a particular signature 26 may be positioned so that the folded edge 28 of the signature is not all the way into the gripper 24 on the gripper drum 14. In this case, the lap edge 30 of the signature 26 might be pushed slightly forward upon engagement by the faster moving gripper seat 100 and rocker arm 90, before the short lap gripper 130 closes on the lap edge of the signature 26. The lap edge 30 is gripped in the correct position by the transfer drum assembly 12. Another signature 26 may be positioned so that its lap edge 30 is closer to the gripper 24 than desired. The timing means 168 ensures that the short lap gripper 130 closes late enough so that it will grip correctly the lap edge 30 of any such signature.

Figure 10:
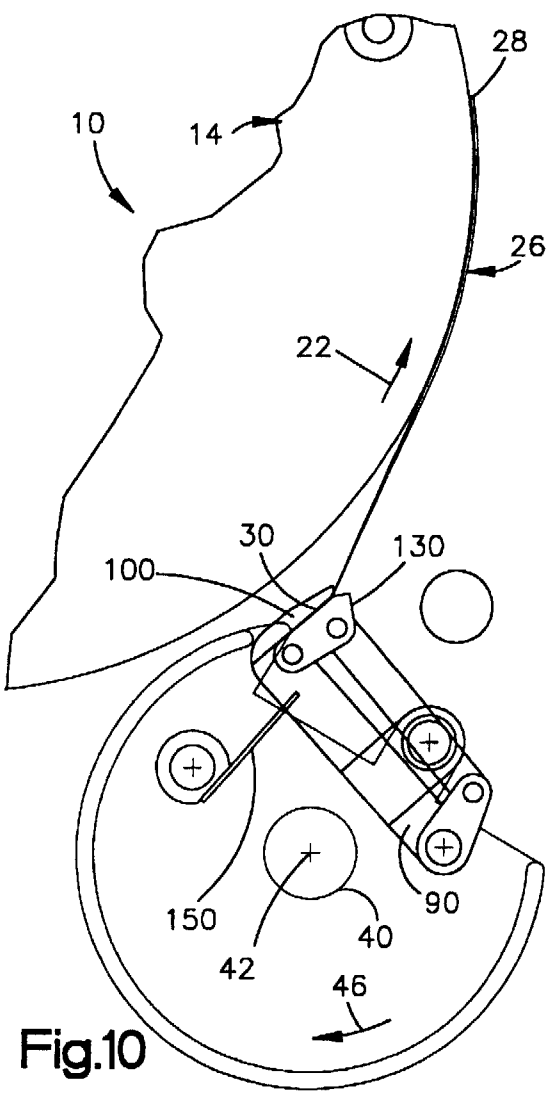
Figure 12:
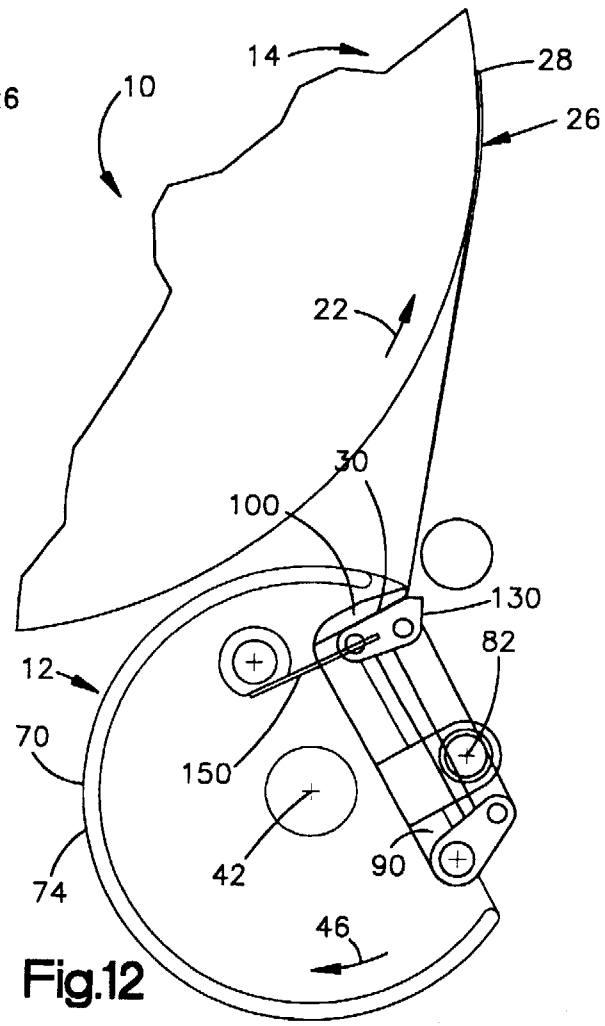
Figure 11:
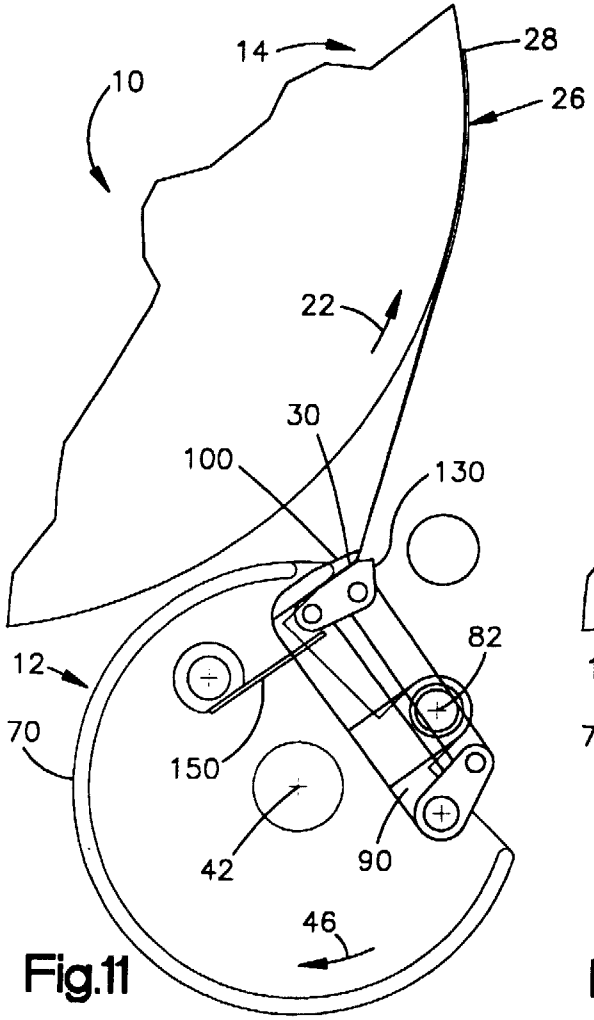

Subsequent to the second increment of rotation, the transfer drum assembly 12 rotates through a third increment of rotation to the position shown in FIG. 12. As the transfer drum assembly 12 rotates past the second increment of rotation, the gripper 24 on the gripper drum 14 releases the folded edge 28 of the signature 26. The rocker arm 90 pivots about the axis 82 from the position shown in FIG. 9, through intermediate positions shown in FIGS. 10 and 11, to the position shown in FIG. 12. The gripper seat 100, which is fixed on the rocker arm 90, moves radially inward. This radial movement of the rocker arm 90 and the gripper seat 100, together with the continued rotation of the transfer drum assembly 12 about the axis 42, draws the lap edge 30 of the signature 26 away from the gripper drum 14 and toward the opener drum 16.

Figure 13:
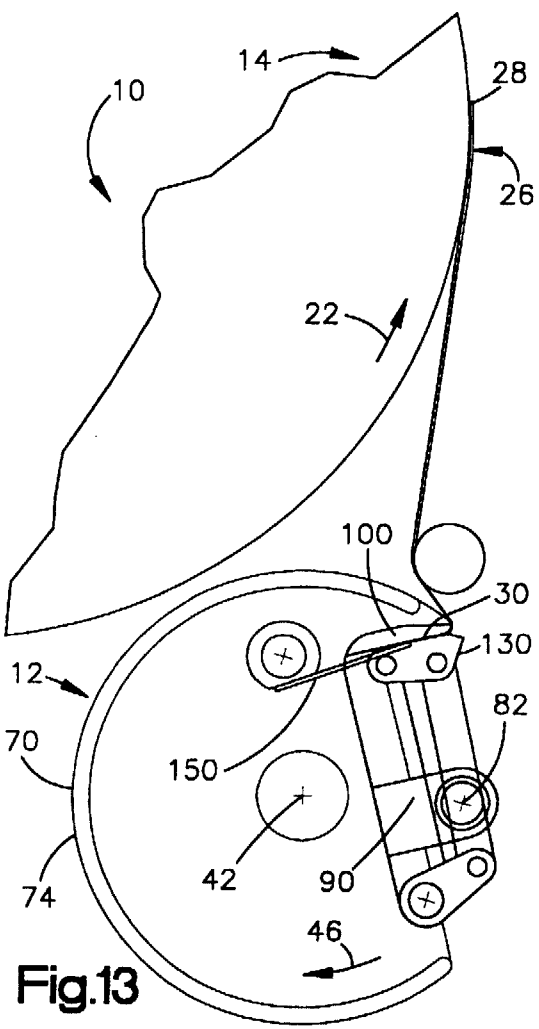

As the transfer drum assembly 12 rotates through the third increment of rotation, the long lap gripper 150 moves from its open position toward and into a closed position as shown in FIG. 13. Specifically, engagement of the long lap cam follower 156 with the long lap cam 54 causes the long lap gripper 150 to move into engagement with the long lap 34 of the signature 26. The long lap gripper 150 holds the long lap 34 of the signature 26 against the gripper seat 100. The long lap gripper 150 does not engage the short lap 32 of the signature 26.

Figure 15:
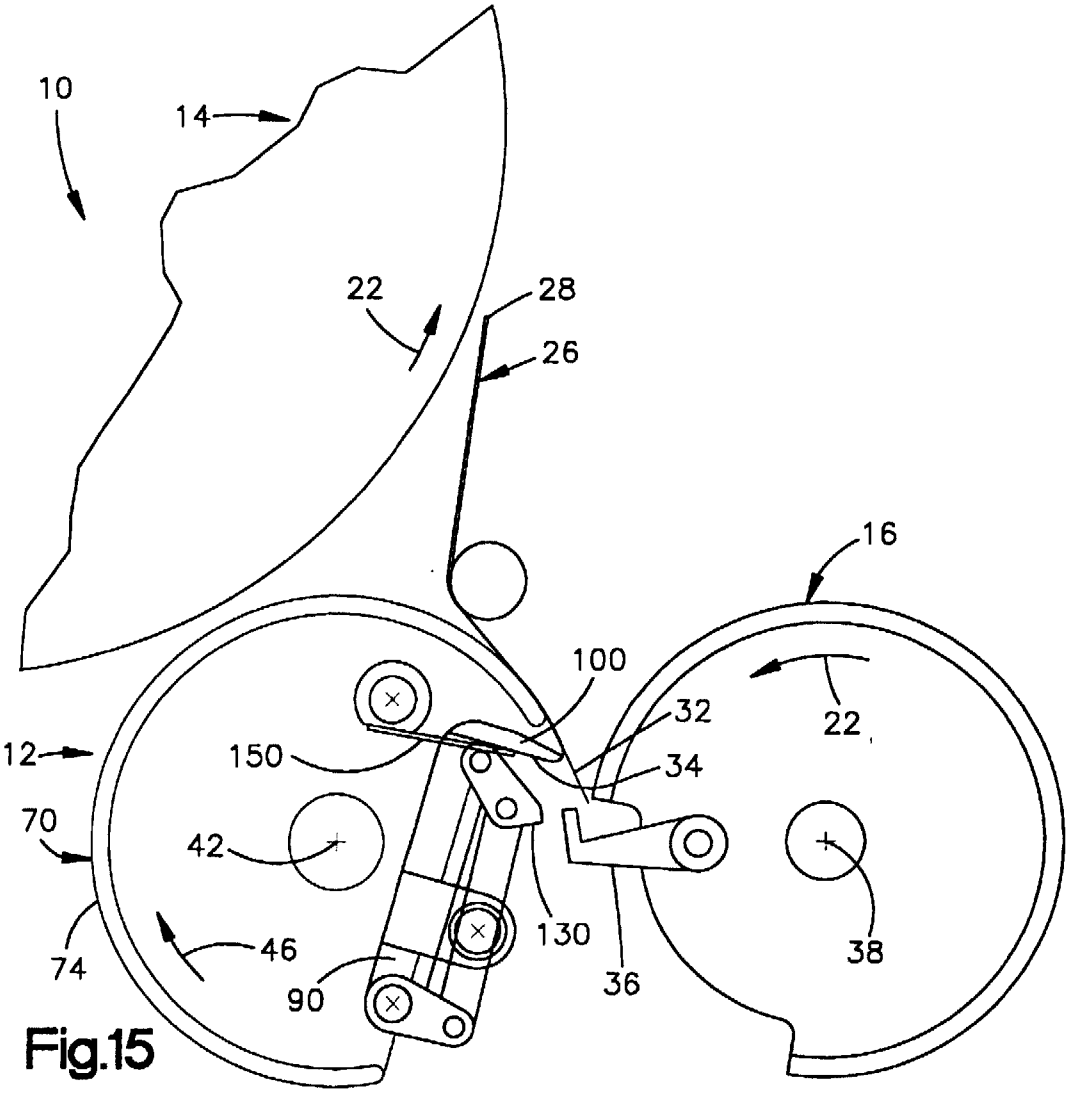
Figure 14:
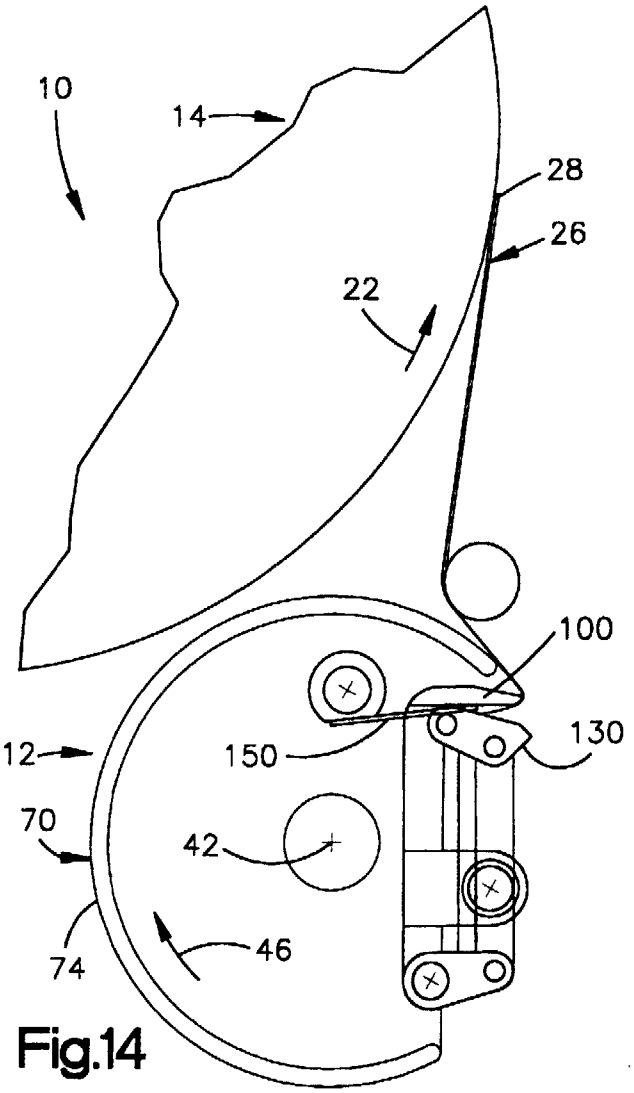

Subsequent to the third increment of rotation, the transfer drum assembly 12 rotates through a fourth increment of rotation to the position shown in FIG. 15. During the fourth increment of rotation, the short lap gripper 130 moves away from the gripper seat 100. The short lap 32 of the signature 26 is released. The long lap 34 of the signature 26 continues to be held against the gripper seat 100 by the long lap gripper 150. The continuous rotation of the transfer drum assembly 12 moves the lap edge 30 of the signature 26 to a position adjacent to the opener drum 16. The short lap 32 of the signature 26, which is not held by the transfer drum assembly 12, is engaged by the gripper 36 on the opener drum 16 in a manner that is common on existing opener drums.

Subsequent to the fourth increment of rotation, the transfer drum assembly 12 rotates through a fifth increment of rotation past the position shown in FIG. 15. The short lap 32 of the signature 26 is separated from the long lap 34 of the signature by the counter-rotating movement of the opener drum 16 and the transfer drum assembly 12. The long lap gripper 150 moves away from the gripper seat 100. The long lap 34 of the signature 26 is released. The opener drum 16 assists in opening of the signature 26, and the signature is deposited onto a saddle or other suitable structure (not shown) for further handling.

As the transfer drum assembly 12 completes its cycle of rotation past the position shown in FIG. 15, and returns to the position shown in FIG. 5, the rocker arm 90 moves the gripper seat 100 into a position radially outward of the outer periphery 74 of the transfer drum 70. The transfer drum assembly 12 is then in a position to engage the trailing lap edge 30 of the next succeeding signature on the gripper drum 14.

From the above description of the invention, those skilled in the art will perceive improvements, changes and modifications in the invention. Such improvements, changes and modifications within the skill of the art are intended to be covered by the appended claims.

Having described the invention, I claim:

1. An apparatus comprising:

a rotatable gripper drum having at least one gripper for gripping and releasing signatures, each signature having a folded leading edge and a trailing edge, said gripper gripping the folded leading edge of signatures;

a rotatable opener drum;

a rotatable transfer drum assembly for transferring signatures from said gripper drum to said opener drum, said transfer drum assembly having at least one transfer gripper;

first drive means for rotating said gripper drum and said at least one transfer gripper to move said folded signatures at a first surface speed in a first direction adjacent to said transfer drum assembly with one respective signature gripped in said at least one gripper on said crisper drum; and second drive means for moving said transfer gripper at a second surface speed in the first direction into engagement with the trailing edge of the one respective signature on said gripper drum while the one respective signature is gripped by said at least one gripper on said gripper drum and said gripper drum is rotating at said first surface speed, said second surface speed being greater than said first surface speed;

said second drive means, rotating said transfer drum assembly to move said transfer gripper and the one signature toward said opener drum;

said opener drum having means for assisting in opening the one signature.

2. An apparatus as set forth in claim 1 wherein said transfer gripper comprises a short lap gripper for gripping a short lap of one respective signature and a long lap gripper for gripping a long lap of the one signature, said long lap gripper being actuatable independently of said short lap gripper.

3. An apparatus as set forth in claim 1 including at least one cam, a cam follower supported for rotation with said transfer drum assembly relative to said at least one cam, and linkage for transmitting radial movement of said cam follower to said transfer gripper to close said transfer gripper when the folded edge of the one signature is gripped by the gripper on said gripper drum.

4. An apparatus as set forth in claim 1 wherein said means on said opener drum for assisting in opening the one signature comprises a gripper on said opener drum, said transfer gripper being actuatable to grip the long lap of the trailing edge of the one signature, said gripper on said opener drum being actuatable to grip the short lap of the trailing edge of the one signature prior to release of the long lap by said transfer gripper.

5. An apparatus as set forth in claim 1 wherein said transfer drum assembly rotates with a surface speed about 50 percent greater than the surface speed of said gripper drum.

6. A signature handling apparatus comprising:

a rotatable gripper drum having at least one gripper for gripping and releasing signatures, each signature having a long lap, a short lap, a folded leading edge and a trailing lap edge, said at least one gripper gripping the folded leading edge of signatures;

a rotatable opener drum;

a rotatable transfer drum assembly for transferring signatures from said gripper drum to said opener drum, said transfer drum having at least one transfer gripper; and drive means for continuously rotating said transfer drum assembly;

said transfer drum assembly comprising:

a transfer drum having an outer periphery;

a gripper seat;

articulation means for supporting said gripper seat on said transfer drum for pivotal movement relative to said transfer drum from a first position disposed radially inward of the outer periphery of said transfer drum to a second position disposed radially outward of the outer periphery of said transfer drum to move said gripper seat into engagement with the trailing lap edge of one respective signature on said gripper drum during a first increment of rotation of said transfer drum assembly;

a short lap gripper for gripping the short lap of the one signature against the gripper seat;

means for supporting said short lap gripper on said transfer drum for movement from an open position to a closed position gripping the short lap of the one signature against said gripper seat during a second increment of rotation of said transfer drum assembly;

said articulation means supporting said gripper seat for movement from the second position to the first position during rotation of said transfer drum assembly subsequent to the second increment of rotation;

said gripper seat and said short lap gripper moving the lap edge of the one signature away from said gripper drum in a direction toward said opener drum during a third increment of rotation of said transfer drum assembly;

a long lap gripper for gripping the long lap of the one signature against the gripper seat; and means for supporting said long lap gripper on said transfer drum for movement independent of said short lap gripper from an open position to a closed position gripping the long lap of the one signature against said gripper seat during a fourth increment of rotation of said transfer drum assembly.

7. An apparatus as set forth in claim 6 wherein said gripper drum rotates at a first surface speed, said drive means rotating said transfer drum assembly at a second surface speed substantially greater than said first surface speed to move said gripper seat into engagement with the trailing lap edge of the one signature.

8. An apparatus as set forth in claim 7 wherein said second surface speed is about 50 percent greater than said first surface speed.

9. An apparatus as set forth in claim 7 comprising cam means for effecting movement of said short lap gripper into the closed position prior to release of the one signature by said gripper drum.

10. An apparatus as set forth in claim 9 wherein said opener drum includes a gripper for assisting in opening the one signature, said gripper on said opener drum being actuatable to grip the trailing edge of the one signature prior to release of the one signature by said transfer drum assembly.

11. An apparatus comprising:

a rotatable gripper drum having at least one gripper for gripping and releasing signatures, each signature having a folded leading edge and a trailing edge, said gripper gripping the folded leading edge of signatures;

a rotatable opener drum;

a rotatable transfer drum assembly for transferring signatures from said gripper drum to said opener drum said transfer drum assembly having at least one transfer gripper;

first drive means for rotating said gripper drum to move said folded signatures at a first surface speed in a first direction adjacent to said transfer drum assembly; and second drive means for moving said transfer gripper at a second surface speed in the first direction into engagement with the trailing edge of one respective signature on said gripper drum, said second surface speed being greater than said first surface speed;

said second drive means, rotating said transfer drum assembly to move said transfer gripper and the one signature toward said opener drum;

said opener drum having means for assisting in opening the one signature;

wherein said transfer drum assembly comprises a transfer drum and means for mounting said transfer gripper on said transfer drum for pivotal movement relative to said transfer drum from a first position disposed radially inward of the outer periphery of said transfer drum to a second position disposed radially outward of the outer periphery of said transfer drum.

* * * * *

UNITED STATES PATENT AND TRADEMARK OFFICE

CERTIFICATE OF CORRECTION

PATENT NO. : 5,893,824

DATED : April 13, 1999

INVENTOR(S) : James Richard Schlough

It is certified that error appears in the above-indentified patent and that said Letters Patent is hereby corrected as shown below:

Column 6, line 65 change "crisper" to "gripper"

Signed and Sealed this

Twenty-eighth Day of November, 2000

*Attest:*

*Attesting Officer*

Q. TODD DICKINSON

*Director of Patents and Trademarks*